US005499960A

United States Patent [19]

Chen

[11] Patent Number: 5,499,960

[45] Date of Patent: Mar. 19, 1996

[54] MULTI-FUNCTIONAL EXERCISE DEVICE

[76] Inventor: Ping Chen, No. 20, Nan-Mei St., Taichung City, Taiwan

[21] Appl. No.: 490,584

[22] Filed: Jun. 15, 1995

[51] Int. Cl.[6] ..... A63B 21/22

[52] U.S. Cl. ..... 482/116; 482/127

[58] Field of Search ..... 482/114, 905, 482/115, 116, 127, 117, 118, 119, 121, 122, 123

[56] References Cited

U.S. PATENT DOCUMENTS

| | | | |
|---|---|---|---|
| 3,467,376 | 9/1969 | Feinberg | 482/905 |
| 3,929,331 | 12/1975 | Beeding | 482/116 |
| 4,010,948 | 3/1977 | Deluty | 482/127 |
| 4,114,875 | 9/1978 | Deluty | 482/127 |
| 4,625,962 | 12/1986 | Street | 482/114 |

OTHER PUBLICATIONS

"American Indian Hand Wrestling Kit", *Sporting Goods Dealer,* Sep. 1973 p. 271.

*Primary Examiner*—Stephen R. Crow

*Attorney, Agent, or Firm*—Ladas & Parry

[57] ABSTRACT

A multi-functional exercise device includes a base plate having opposed first and second end portions and an intermediate portion between the first and second end portions. An upright hollow housing has a bottom end mounted on the base plate at an intermediate section of the first end portion of the base plate so as to form two tread sections on the base plate on two sides of the housing, and a top end which has a top plate mounted thereon. The top plate is formed with a passage unit for access into an interior of the housing. The base plate is formed with an elbow-receiving depression at the intermediate portion thereof. The elbow-receiving depression is located between the two tread sections and immediately adjacent the housing. A driving unit includes a horizontal shaft which is disposed inside the housing and which is mounted rotatably on the base plate, a driving rope having a first end portion attached to the shaft and a second end portion extending out of the housing through the passage unit, a hand-gripping member secured to the second end portion of the driving rope, and a biasing unit for biasing the shaft to rotate so as to wind normally the driving rope on the shaft. A damping unit is disposed inside the housing and is associated operably with the shaft. The damping unit provides resistance to damp rotation of the shaft.

8 Claims, 9 Drawing Sheets

MULTI-FUNCTIONAL EXERCISE DEVICE

BACKGROUND OF THE INVENTION

1. Field of the Invention

This invention relates to a multi-functional exercise device, more particularly to a multi-functional exercise device for use in a large variety of different positions.

2. Description of the Related Art

Presently, there are many type of exercise devices available in the market. One of those conventional exercise devices has been disclosed in U.S. Pat. No. 4,625,962 issued to Street. Street discloses an exercise device comprising a support frame, a rotating shaft mounted rotatably on the support frame, and a coiled spring having a first end connected to the rotatable shaft via a spring holder and a second end connected to the support frame. The rotatable shaft is rotatable between a first direction and a second direction opposite to the first direction. A drive means includes a rope which has a first end connected to the rotatable shaft via the drive means. The rope is wound around the drive means. An adjustable drag means includes a flywheel mounted fixedly on the rotatable shaft and a belt. The belt has a first end connected to the support frame and a second end to which weights are connected. The belt extends through a channel in the flywheel in order to provide resistance to damp rotation of the rotatable shaft when the rotatable shaft is rotated in the first direction. The coiled spring is wound when the rope is pulled to cause rotation of the rotatable shaft in the first direction. The coiled spring unwinds to cause the rotatable shaft to rotate in the second direction when the rope is released.

Another conventional exercise device, which was disclosed in U.S. Pat. No. 4,077,626 issued to Newman, comprises a pair of lines, a pair of spools and a spiral spring which provides a force for rewinding the lines on the respective spool.

Still another conventional exercise device was disclosed in U.S. Pat. No. 4,114,875 issued to Deluty and comprises a cord that extends between a wedge member and a cord-contacting portion of a support member, a control knob that is mounted threadably on a housing, and a compression spring that is disposed between the knob and the support member. The friction between the cord and the wedge member and cord-contacting portion of the support member functions as a resistance against a user's pull on the cord. Rotation of the knob will cause the spring to bias the cord-contacting portion of the support member to move relative to the wedge member so as to adjust the resistance against the user's pull on the cord.

SUMMARY OF THE INVENTION

The objective of the present invention is to provide a multi-functional exercise device which can be used to exercise different body parts and which occupies a relatively small space.

According to the present invention, a multi-functional exercise device includes a base plate having opposed first and second end portions and an intermediate portion between the first and second end portions. An upright hollow housing has a bottom end mounted on the base plate at an intermediate section of the first end portion of the base plate so as to form two tread sections on the base plate on two sides of the housing, and a top end which has a top plate mounted thereon. The top plate is formed with a passage unit for access into an interior of the housing. The base plate is formed with an elbow-receiving depression at the intermediate portion thereof. The elbow-receiving depression is located between the two tread sections and immediately adjacent the housing. A driving unit includes a horizontal shaft which is disposed inside the housing and which is mounted rotatably on the base plate, a driving rope having a first end portion attached to the horizontal shaft and a second end portion extending out of the housing through the passage unit, a hand-gripping member secured to the second end portion of the driving rope, and biasing means for biasing the horizontal shaft to rotate so as to wind normally the driving rope on the shaft. A damping unit is disposed inside the housing and is associated operably with the horizontal shaft. The damping unit provides resistance to damp rotation of the horizontal shaft.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
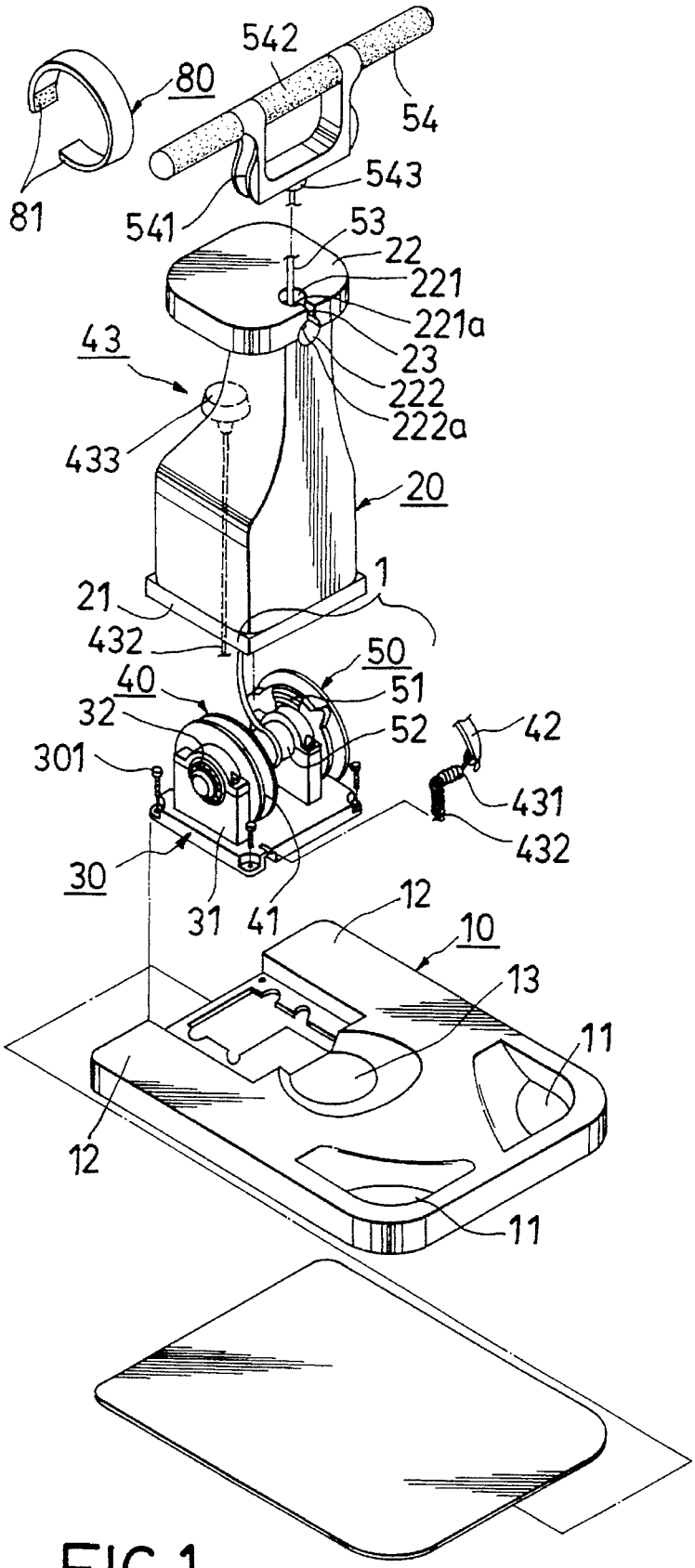
FIG. 1 is a partly exploded view showing a multi-functional exercise device according to the present invention.
Figure 2:
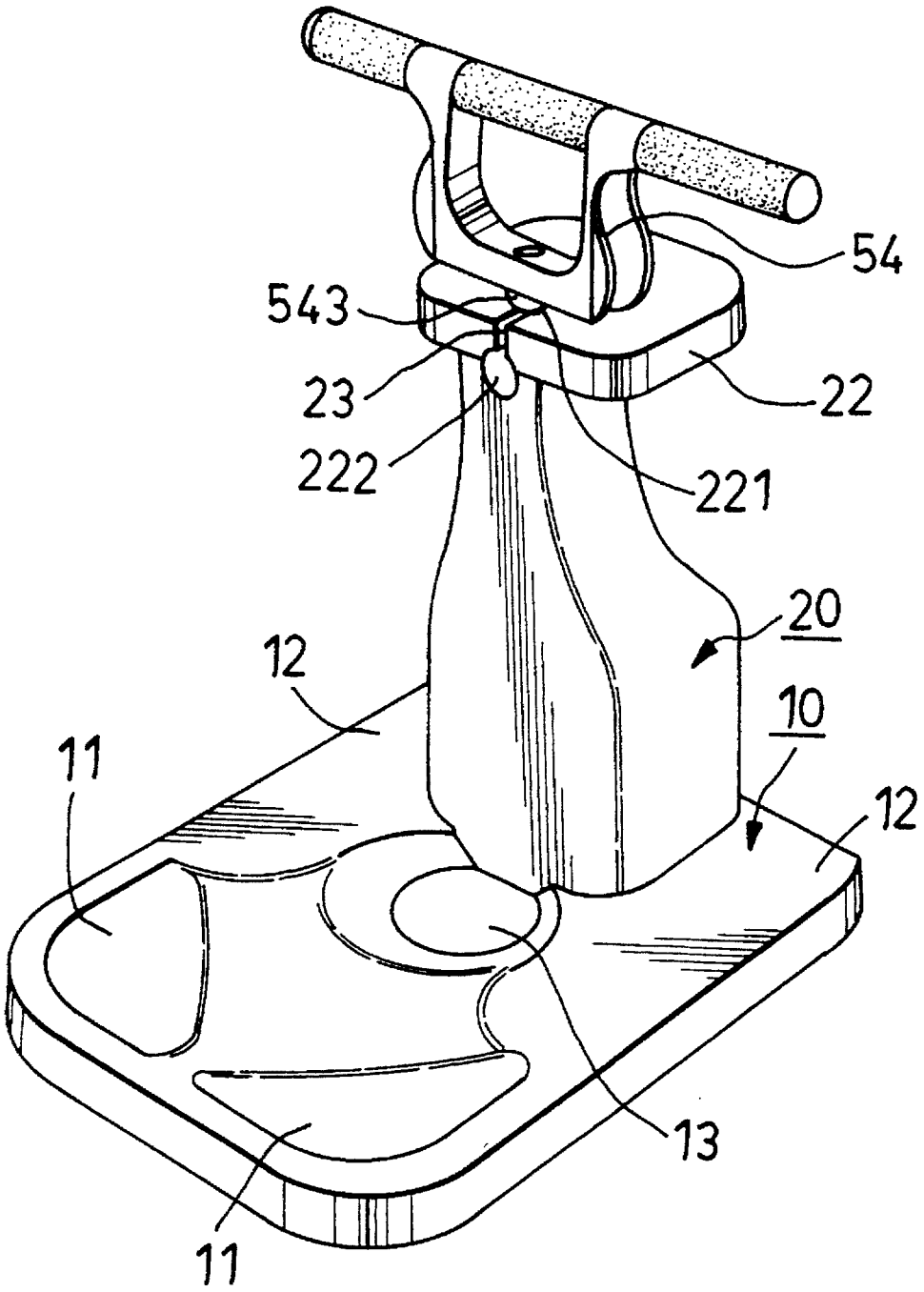
FIG. 2 is a perspective view of the multi-functional exercise device shown in FIG. 1.

Referring to FIGS. 1 and 2, a multi-functional exercise device according to the present invention is shown to include a base plate 10, an upright hollow housing 20, a generally U-shaped support 30, a driving unit 50, a damping unit 40, and a fastening strap 80.

The base plate 10 has opposed first and second end portions and an intermediate portion between the first and second end portions. The base plate 10 is formed with two hand-gripping depressions 11 at opposite sides of the second end portion of the base plate 10.

The hollow housing 20 has a bottom end 21 mounted on the base plate 10 at an intermediate section of the first end portion of the base plate 10 so as to form two tread sections 12 on the base plate 10 on two sides of the housing 20. The housing 20 further has a top end on which a top plate 22 is mounted. The top plate 22 is formed with a passage unit. In the present embodiment, the passage unit includes a longitudinal hemispherical recess 221 which opens at a top surface of the top plate 22 and a transverse hemispherical recess 222 which opens at a side surface of the top plate 22 and which is communicated with the longitudinal hemispherical recess 221 via a slit 23 formed in the side surface of the top plate 22. It is noted that each of the recesses 221,222 defines a through-hole 221*a*,222*a* for access into an interior of the housing 20.

The base plate 10 is further formed with an elbow-receiving depression 13 at the intermediate portion thereof. The elbow-receiving depression 13 is located between the two tread sections 12 and immediately adjacent the housing 20.

The support 30 is disposed inside the housing 20 and is mounted on the base plate 10 by means of screws 301. The support 30 includes a pair of vertical support plates 31 on which a pair of bearings 32 are mounted.

The driving unit 50 includes a horizontal shaft 52 which is disposed inside the housing 20 and which is mounted rotatably on the support 30 at two ends thereof by means of the bearings 32. A driving rope 53 has a first end portion attached to the horizontal shaft 52 and a second end portion extending out of the housing 20 through a selected one of the recesses 221,222 of the passage unit. A hand-gripping member 54 is secured to the second end portion of the driving rope 53. In the present embodiment, the hand-gripping member 54 includes a generally U-shaped frame 541 having two distal ends, and an elongated rod 542 connected transversely to the distal ends of the frame 541. The frame 541 has an intermediate section formed with a hemispherical protrusion 543 which is receivable selectively in one of the hemispherical recesses 221,222 of the top plate 22 of the housing 20, depending on which one of the recesses 221,222 does the second end portion of the driving rope 53 extend through. The driving unit 50 further includes biasing means 51 for biasing the horizontal shaft 52 to rotate so as to wind normally the driving rope 53 on the horizontal shaft 52. In the present embodiment, the biasing means 51 is a volute spring having a first end portion connected to the horizontal shaft 52 and a second end portion connected to the support 30.

The damping unit 40 is disposed inside the housing 20 and is associated operably with the horizontal shaft 52 so as to provide resistance to damp rotation of the horizontal shaft 52. The damping unit 40 includes a wheel 41 mounted securely on the horizontal shaft 52, a damping strap 42 which has a first end portion connected to the support 30, an intermediate portion passing along at least a portion of a rim of the wheel 41, and a second end portion, and a resistance adjusting unit 43. The resistance adjusting unit 43 includes a tension spring 431 which has a first end connected to the second end portion of the damping strap 42 and a second end, a cable 432 which has a first end connected to the second end of the tension spring 431 and a second end, and a rotatable knob 433 which is mounted threadably on the housing 20 and which is connected to the second end of the cable 432. Therefore, rotation of the rotatable knob 433 results in adjustment of tension of the damping strap 42 on the wheel 41 to vary the resistance provided by the damping unit 40 to the rotation of the horizontal shaft 52. The fastening strap 80 is coupled removably to the elongated rod 542 of the hand-gripping member 54 between distal ends of the frame 541 and is provided with a hook and loop fastening tape 81. The function of the fastening strap 80 will be described hereinafter.

Figure 3:
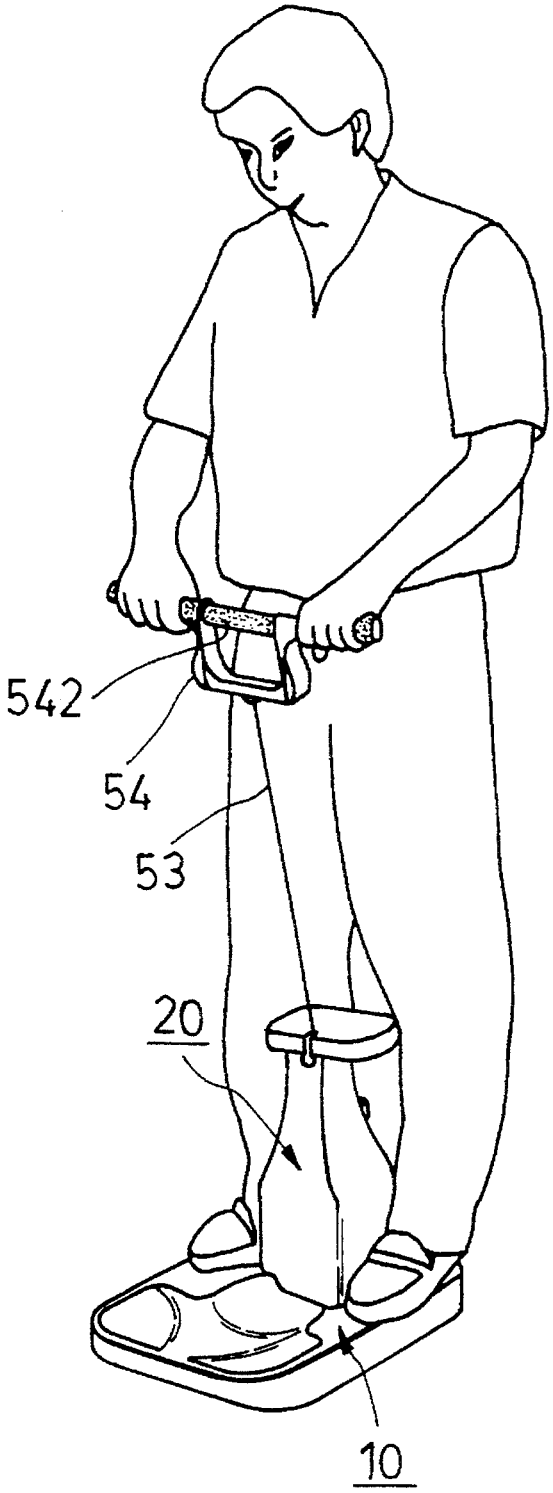
FIGS. 3 to 5 are perspective views showing how the multi-functional exercise device of the present invention is used for training the arms and waist of a user.
Figure 4:
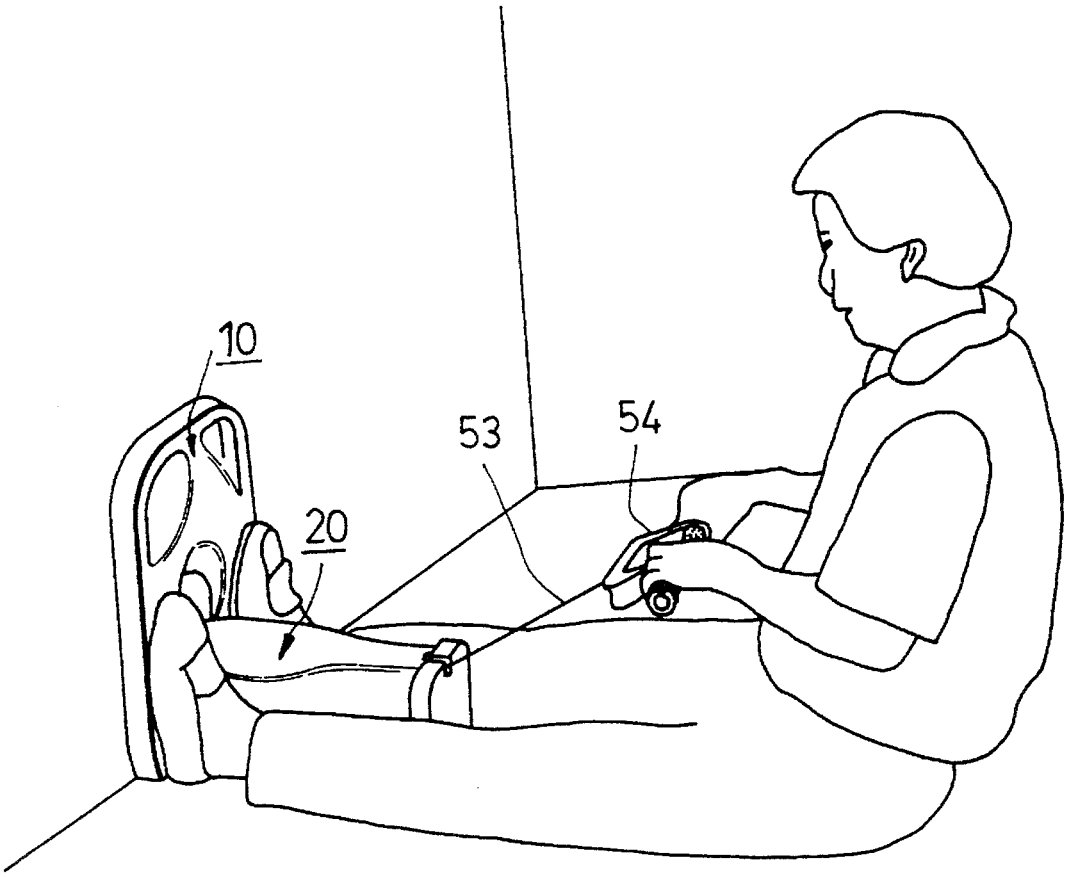
Figure 5:
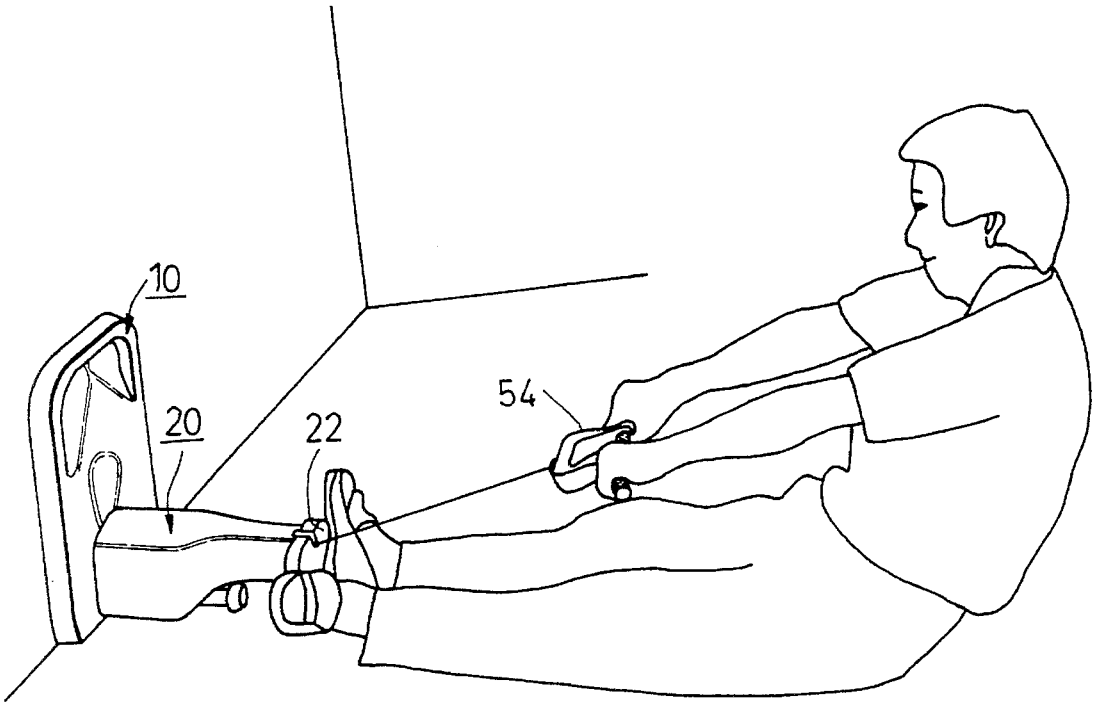

FIGS. 3 to 5 show how the multi-functional exercise device of the present invention is used for training the arms and the waist of a user. In FIG. 3, the user stands on the tread sections 12 of the base plate 10 with his feet on two sides of the housing 20 and grasps the distal end portions of the elongated rod 542 of the hand-gripping member 54 in order to pull the driving rope 53. Since the user must bend his waist before pulling the driving rope 53, repeated pulling and release of the driving rope 53 by the user permits exercising of the arms and waist of the user. As shown in FIG. 4, the user is sitted on the floor, pushes the base plate 10 with his feet against a wall, and clamps the housing 20 between his calfs. Then, the hand-gripping member 54 is operated by the user so as to repeatedly pull and release the driving rope 53, thereby resulting in exercising of the arms and waist of the user. In FIG. 5, the user is sitted on the floor and pushes the base plate 10 to rest against a wall by pushing the top plate 22 of the housing 20 with his feet. Then, the hand-gripping member 54 is operated by the user in a manner similar to that described in FIG. 4, thereby resulting in an exercise effect to the user's arm and waist.

Figure 6:
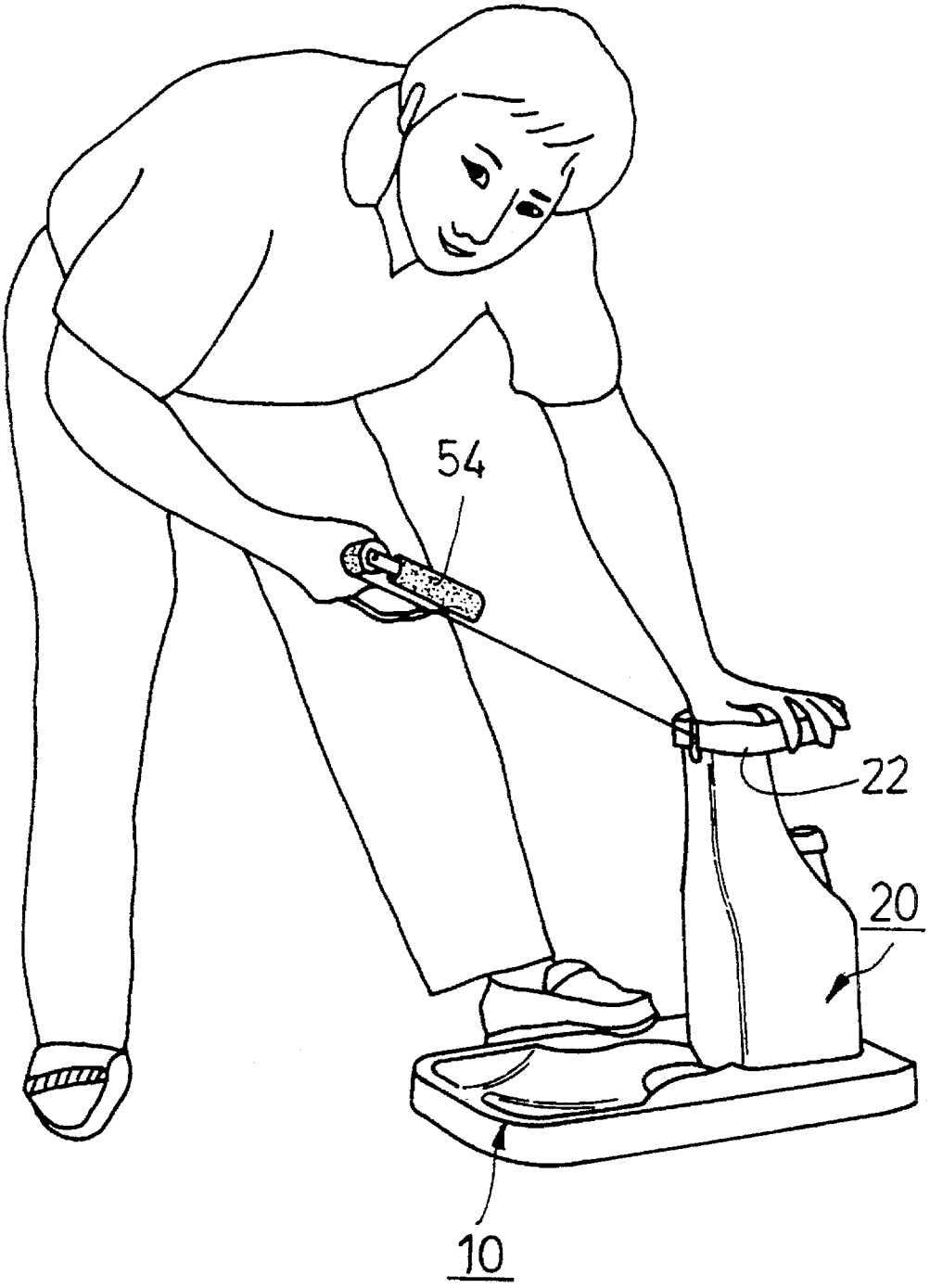
FIG. 6 is a perspective view showing how the multi-functional exercise device of the present invention is used for training the arms and wrists of the user.

FIG. 6 shows how the multi-functional exercise device of the present invention can be used to train the arms and wrists of the user. The user steps on the base plate 10 with one foot and presses the top plate 22 of the housing 20 with one hand. The hand-gripping member 54 is then operated with the other hand in a similar manner so as to achieve the desired exercise result.

Figure 7:
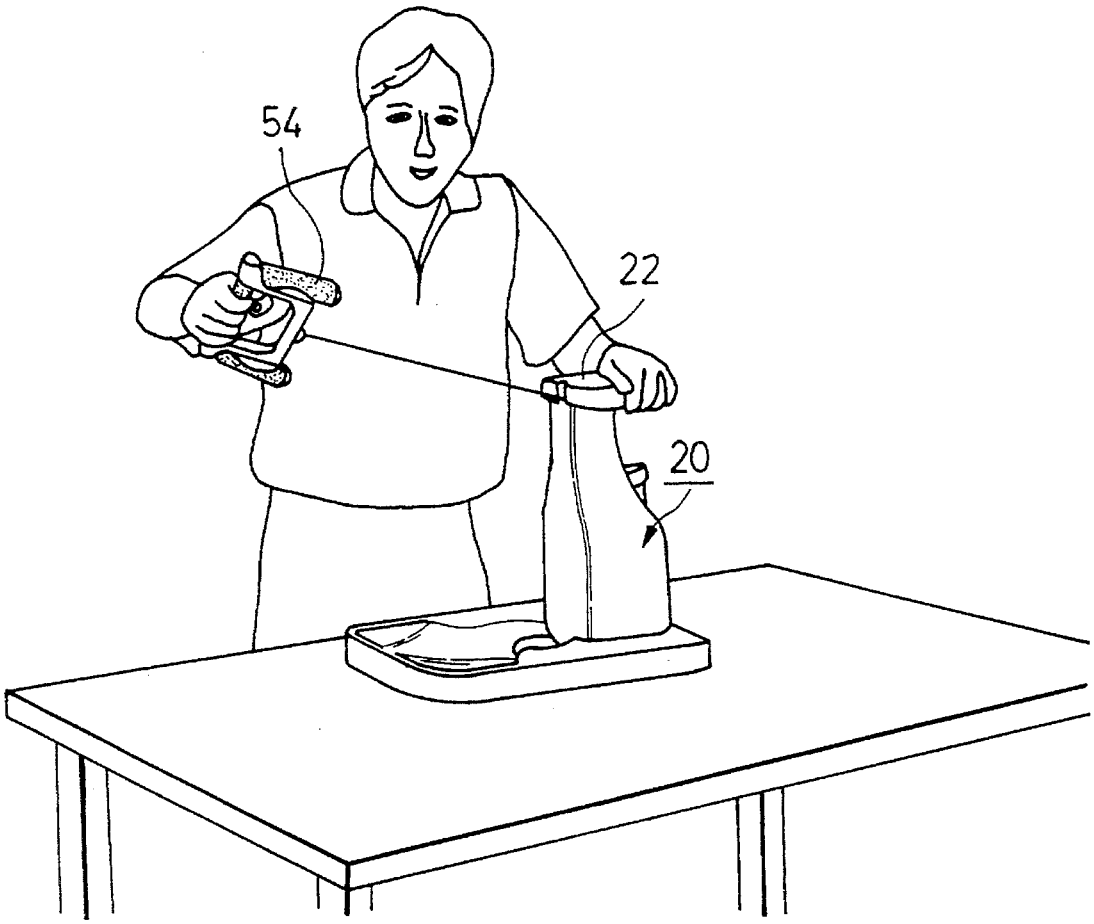
FIG. 7 is a perspective view showing how the multi-functional exercise device of the present invention is used for training the arms and chest of the user.

FIG. 7 shows how the multi-functional exercise device of the present invention is used for training the arms and chest of the user. The exercise device is positioned on a table by using one hand to press against the top plate 22 of the housing 20. The hand-gripping member 54 is then operated with the other hand so as to achieve the desired exercise result.

Figure 8:
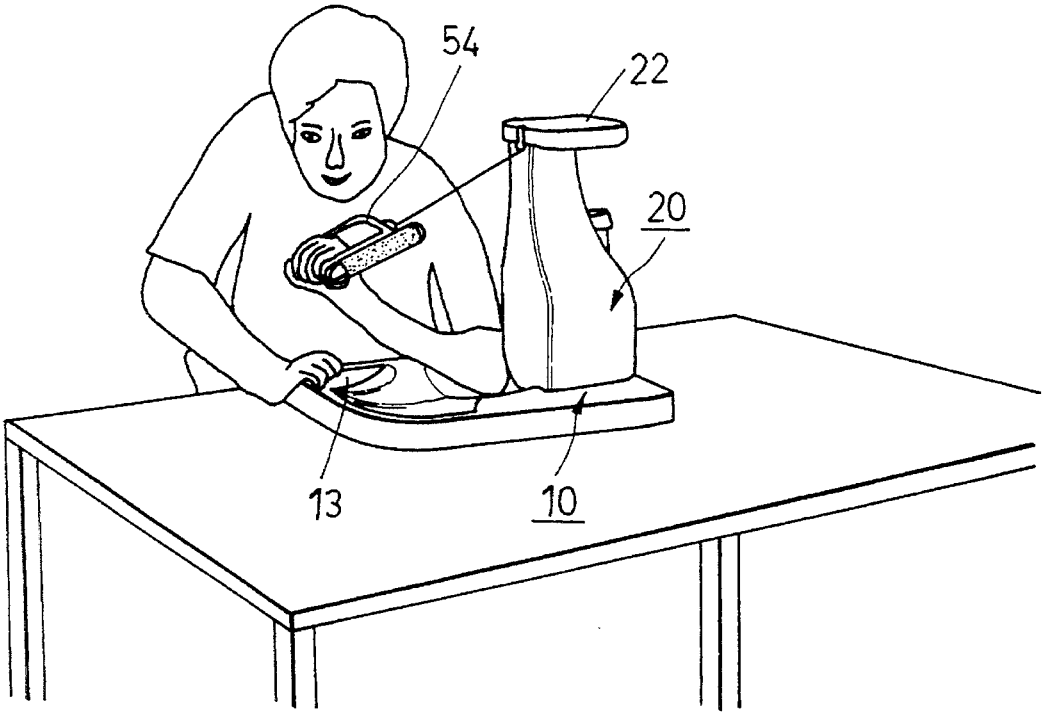
FIG. 8 is a perspective view showing how the multi-functional exercise device of the present invention is used for training the wrist of the user.

FIG. 8 shows how the multi-functional exercise device of the present invention is used for training the wrists of the user. The user positions the exercise device on a table by placing the elbow of one arm in the elbow-receiving depression of the base plate 10 and by grasping one hand-gripping depression 13 of the base plate 10 with the other hand. The hand-gripping member 54 is then operated so as to achieve the desired exercise result.

Figure 9:
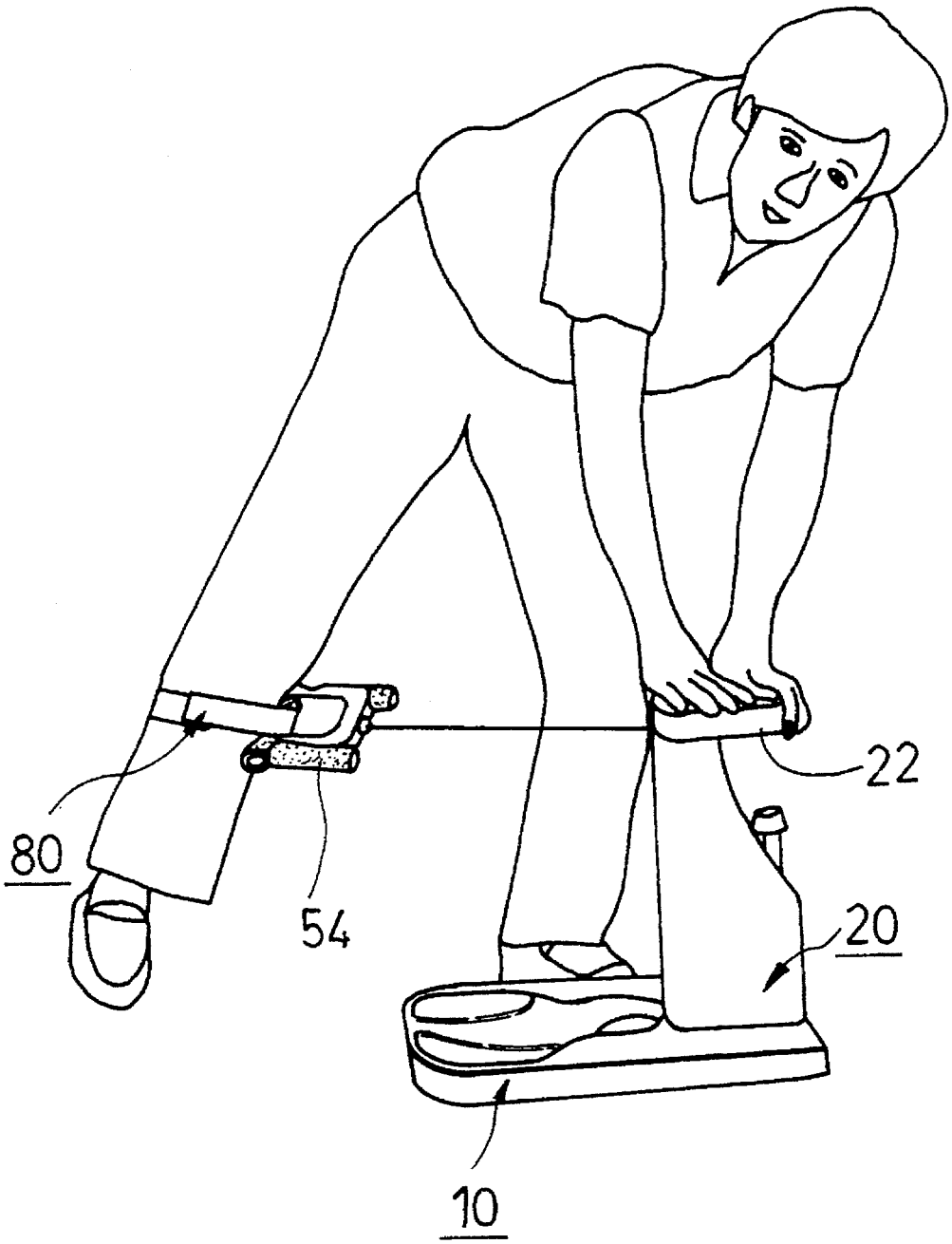
FIG. 9 is a perspective view showing how the multi-functional exercise device of the present invention is used for training the legs of the user.

FIG. 9 shows how the multi-functional exercise device of the present invention is used for training the legs of the user. The exercise device is positioned by placing the hands against the top plate 22 of the housing 20. The fastening strap 80 is then used to bind one leg of the user to the hand-gripping member 54 to permit operation of the latter so as to achieve the desired exercise result.

According to the accompanying drawings, it should be noted that, when the multi-functional exercise device of the present invention is not in use, the hemispherical protrusion 543 of the hand-gripping member 54 is receivable selectively in one of the hemispherical recesses 221,222 of the top plate 22 of the housing 20.

It has thus been shown that the multi-functional exercise device of the present invention, which occupies a relatively small space, can be used to exercise different body parts. The objective of the present invention is thus met.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A multi-functional exercise device, comprising:

a base plate having opposed first and second end portions and an intermediate portion between said first and second end portions;

an upright hollow housing having a bottom end mounted on said base plate at an intermediate section of said first end portion of said base plate so as to form two tread sections on said base plate on two sides of said housing, and a top end which has a top plate mounted thereon, said top plate being formed with a passage unit for access into an interior of said housing, said passage unit includes a longitudinal hemispherical recess which opens at a top surface of said top plate and a transverse hemispherical recess which opens at a side surface of said top plate and which is communicated with said longitudinal hemispherical recess;

said base plate being formed with an elbow-receiving depression at said intermediate portion thereof, said elbow-receiving depression being located between said two tread sections and immediately adjacent said housing;

a driving unit including a horizontal shaft which is disposed inside said housing and which is mounted rotatably on said base plate, a driving rope having a first end portion attached to said horizontal shaft and a second end portion extending out of said housing through said passage unit, a hand-gripping member secured to said second end portion of said driving rope, and biasing means for biasing said horizontal shaft to rotate so as to wind normally said driving rope on said shaft; and a damping unit, disposed inside said housing and associated operably with said horizontal shaft, for providing resistance to damp rotation of said horizontal shaft.

2. A multi-functional exercise device as claimed in claim 1, wherein said base plate is further formed with two hand-gripping depressions at opposite sides of said second end portion of said base plate.

3. A multi-functional exercise device as claimed in claim 1, wherein said hand-gripping member includes a generally U-shaped frame having two distal ends, and an elongated rod connected transversely to said distal ends of said frame.

4. A multi-functional exercise device as claimed in claim 3, wherein said frame of said hand-gripping member has an intermediate section formed with a hemispherical protrusion which is receivable selectively in one of said hemispherical recesses of said top plate of said housing.

5. A multi-functional exercise device as claimed in claim 4, further comprising a fastening strap coupled removably to said elongated rod of said hand-gripping member.

6. A multi-functional exercise device as claimed in claim 1, further comprising a generally U-shaped support disposed inside said housing and mounted on said base plate, said horizontal shaft being mounted rotatably on said support at two ends thereof.

7. A multi-functional exercise device as claimed in claim 6, wherein said biasing means of said driving unit is a volute spring having a first end portion connected to said horizontal shaft and a second end portion connected to said support.

8. A multi-functional exercise device as claimed in claim 6, wherein said damping unit comprises:

a wheel mounted securely on said horizontal shaft;

a damping strap which has a first end portion connected to said support, an intermediate portion passing along at least a portion of a rim of said wheel, and a second end portion; and a resistance adjusting unit including a tension spring which has a first end connected to said second end portion of said damping strap and a second end, and a rotatable knob which is mounted threadably on said housing and which is connected to said second end of said tension spring;

whereby, rotation of said rotatable knob results in adjustment of tension of said damping strap on said wheel to vary the resistance provided by said damping unit to the rotation of said horizontal shaft.

* * * * *